United States Patent [19]

Masters et al.

[11] Patent Number: 4,926,297

[45] Date of Patent: May 15, 1990

[54] COLLAPSIBLE LANTERN

[76] Inventors: Edward R. Masters, 7957 Treasury Dr., Dayton, Ohio 45429; Peter C. Benjamin, 920 N. Ontare Rd., Santa Barbara, Calif. 93105

[21] Appl. No.: 357,997

[22] Filed: May 30, 1989

[51] Int. Cl.[5] ..... F21L 19/02

[52] U.S. Cl. ..... 362/162; 362/180; 362/314; 362/399; 362/450

[58] Field of Search ..... 362/159, 160, 161, 162, 362/163, 181, 182, 180, 266, 312, 314, 316, 399, 449, 450; 431/311, 291

[56] References Cited

U.S. PATENT DOCUMENTS 4,186,430 1/1980 Britton ..... 361/162
4,520,431 5/1985 Fanelli et al. ..... 362/180
4,566,055 1/1986 Klees et al. ..... 362/314 X
4,646,213 2/1987 Fanelli et al. ..... 362/180

*Primary Examiner*—Stephen F. Husar
*Attorney, Agent, or Firm*—Jacox & Meckstroth

[57] ABSTRACT

A cylindrical glass globe is supported by an annular rigid plastic coupling member which seats and locks onto the top portion of a tubular rigid plastic housing. A fuel source in the form of a container of liquid fuel mounted on a bottom adaptor or a candle supported within a rigid casing by a compression spring, is supported within the housing by a rigid plastic base removably secured to the bottom of the housing. The globe and coupling member are inverted as a unit after being removed from the housing, and the globe is inserted into the housing around the fuel source for storage and protection of the globe. A bail-type handle connects a pair of strips slidably supported by the housing.

20 Claims, 1 Drawing Sheet

COLLAPSIBLE LANTERN

BACKGROUND OF THE INVENTION

This invention relates to a collapsible lantern of the general type disclosed in U.S. Pat. Nos. 4,186,430, 4,520,431 and 4,646,213. In the lantern disclosed in U.S. Pat. No. 4,186,430, the globe slides vertically from a stored position within a surrounding housing to an elevated position for use. In the collapsible lantern disclosed in the latter two patents, the cylindrical transparent globe is also shifted vertically between an elevated position during use and a lower retracted position for storage. In the stored position, the globe surrounds the container of liquid fuel, and the globe is exposed to possible scratching or breakage. To protect the globe during storage and transporting, the lantern assembly is enclosed within a semi-rigid plastic container with removable end caps, as shown in FIG. 1 of the patents. In the elevated position, the globe is supported by a set of retractable spring stainless steel legs. However, the legs and plastic storage container add significantly to the total cost of the collapsible lantern.

SUMMARY OF THE INVENTION

The present invention is directed to an improved collapsible lantern which provides for easy cleaning of the globe, high durability and for relative inexpensive construction. The lantern also has a fuel source which may be either a container of liquid oil or a candle, which ever is desired. In accordance with one embodiment of the invention, a cylindrical transparent globe is secured to a rigid plastic annular coupling by a set of clip-on spring retainer arms, and the coupling seats on a rigid plastic tubular housing which encloses a fuel source in the form of either a spring loaded candle within a metal casing or a metal container of lamp oil and having a wick sealed by a screw-on cap and resilient washer. A rigid plastic base is removably secured to the bottom of the housing and interlocks with either the casing enclosing the candle or an adaptor mounted on the bottom of the oil container. The housing supports a pair of vertically slidable straps connected by a pivotal bail-type handle. When the globe and coupling are removed from the housing as a unit, the unit is inverted, the globe is inserted down into the housing around the fuel source, and the coupling snap-fits into the housing.

Other features and advantages of the invention will be apparent from the following description, the accompanying drawing and the appended claims.

DESCRIPTION OF THE PREFERRED EMBODIMENTS

Figures 1, 2, 3, 4:
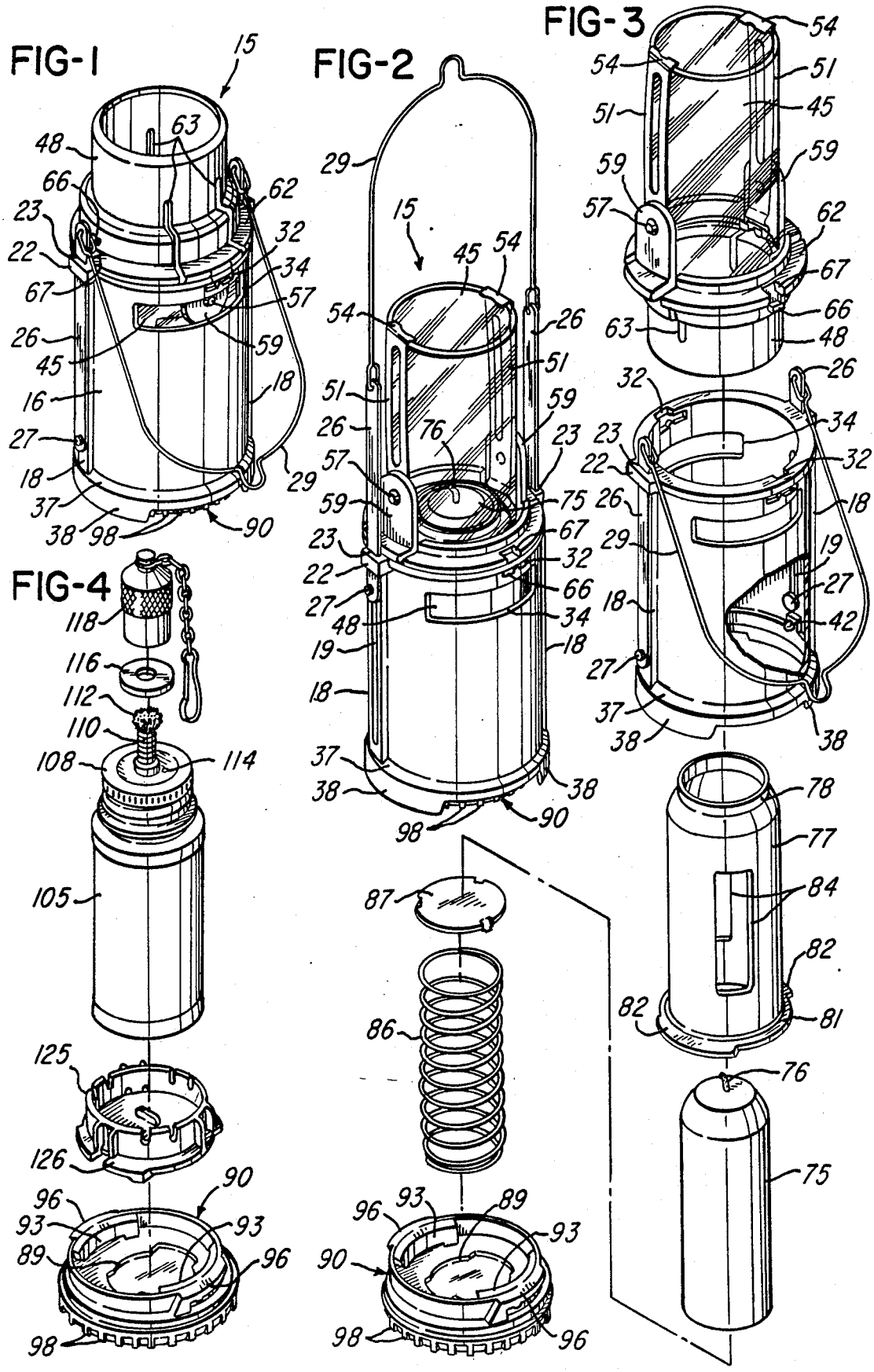
FIG. 1 is a perspective view of a lantern constructed in accordance with the invention and shown in its collapsed position.
FIG. 2 is a perspective view of the lantern of FIG. 1 and showing it in an extended position ready for use.
FIG. 3 is an exploded perspective view of the lantern shown in FIGS. 1 and 2 and illustrating a fuel source in the form of a candle unit.
FIG. 4 is an exploded perspective view of a fuel source in the form of a container of lamp oil and snap-on adaptor support.

FIG. 1 illustrates a collapsible lantern 15 which includes a generally cylindrical or tubular housing 16 molded of a rigid plastics material. The housing 16 has a pair of diametrically opposite and vertically extending ribs 18 which defined vertical slots 19 directly under corresponding projections 22 defining horizontal slots 23. A pair of stainless steel vertical strips 26 are slidable on the ribs 18 and through the slots 23, and the strips have lower end portions connected to the housing 16 by a pair of rivets 27 which slide within the slots 19. A bail-type handle 29 has opposite end portions pivotally connected to upper end portions of the strips 26 and provides for moving the strips between retracted positions (FIG. 1) and upwardly extended or elevated positions (FIG. 2) when it is desired to suspend the lantern 15 from a fixed support.

The upper end portion of the housing 16 has a pair of diametrically opposed bayonet-shaped slots 32 (FIG. 3) which extend downwardly from a top flange 33, and a pair of diametrically opposite arcuate openings 34 are also formed in the upper portion of the housing 16 below the slots 32. The housing 16 has a base portion formed by an outwardly projecting flange 37 and downwardly projecting arcuate legs or ribs 38, and a pair of diametrically opposed studs or projections 42 are also molded as an integral part of a tubular housing 16.

The lantern 15 includes a tubular or cylindrical glass globe 45 which has a lower end portion (FIG. 3) spaced within a surrounding annular coupling member 48 molded of a rigid plastics material. The globe 45 is supported within the coupling member 48 by a pair of thin stainless steel strips 51 having hook-shaped lower end portions 52 which receive the lower end portion of the globe 45. The strips 51 have slightly hook-shaped upper end portions 54 which clip or snap onto the upper end portion of the globe 45. The outer diameter of the globe 45 is somewhat smaller than the inner diameter of the coupling member 48 to define therebetween an annular air gap of about $\frac{1}{8}$ inch.

The globe retaining strips 51 are secured to the coupling member 48 by a pair of rivets 57 which extend through upwardly projecting tabs 59 molded as an integral part of the coupling member 48. The coupling member 48 has an outwardly projecting flange 62 which is interrupted by slots 63 on opposite sides of each tab 59 to permit each tab 59 to flex slightly in a spring-like manner. A pair of diametrically opposite projections 66 (FIG. 1) are molded as an integral part of the coupling member 48 directly above corresponding slots 67 also interrupting the flange 62.

The assembly of the globe 45 and coupling member 48 form a unit which is mounted on the housing 16 in an inverted position when the lantern 15 is in its collapsed position, as shown in FIG. 1. In this inverted position, the globe 45 projects downwardly into the housing 16 until the flange 62 seats on the flange 33 which has the same diameter as the flange 62. When the tabs 59 of the coupling member 48 are pressed downwardly into the upper portion of the housing 16, the projecting heads of the rivets 57 cam the tabs inwardly by a slight amount until the rivets 57 snap outwardly into the slots 34 of the housing 16, as shown in FIG. 1. This snap fit of the rivets 57 provides a friction detent-type retention of the globe and coupling unit in its collapsed stored position.

When it is desired to use the lantern 15, the coupling member 48 is pulled upwardly form the housing 16 to remove the globe and coupling unit from the housing. The unit is then inverted, and the coupling member 48 is seated downwardly on the flange 33 with the projections 66 aligned with the bayonet-type slots 32. After the projections 66 enter the slots 32, the coupling member 48 is rotated by a few degrees which cam locks the coupling member 48 to the housing 16 in the extended position, as shown in FIG. 2.

The lantern 15 is constructed to use alternate fuel sources. One fuel source is shown in FIG. 3 and includes a wax candle 75 having a wick 76 and confined within a thin aluminum or metal shell 77. The shell has a reduced cylindrical portion 78 defining a top opening and also has an outwardly projecting bottom flange 81. A pair of diametrically opposite arcuate tabs 82 project outwardly as extensions of the bottom flange 81, and a pair of rectangular openings 84 are formed within the cylindrical side wall of the shell 76. A compression spring 86 and a cap plate 87 are retained within the shell 76 below the candle 75 and urge the candle upwardly against the top portion 78. The lower convolution of the spring 86 seats within a recess 89 of a base cap 90 molded of a rigid plastics material.

After the candle 75, top plate 87 and spring 86 are inserted into the shell 76, the bottom flange 81 of the shell is inserted into the base cap 90 and then twisted until the projecting flange portions 82 wedge under diametrically opposed inner cam portions 93 of the base cap 90. The cap 90 is also molded with a pair of diametrically opposite cam portions 96 which project outwardly and define thereunder cam slots. The slots receive the inwardly projecting studs or projections 42 within the housing 16 when the base cap 90 is inserted into the base portion of the housing 16 and twisted by approximately 90 degrees to a locked position. A series of peripherally spaced teeth 98 are molded as part of the base cap 90 to facilitate gripping and twisting of the cap 90 for attaching and the cap to the base portion of the housing and for removing the cap.

As an alternate source of fuel, the lantern 15 is also adapted to receive a metal container 105 (FIG. 4) of lamp oil. A metal cap 108 is threadably connected to the container 105 and supports an externally threaded tube 110 through which a wick 112 extends to the bottom of the container. As also disclosed in above mentioned U.S. Pat. Nos. 4,520,431 and 4,646,213, the cap 108 has an air breather hole 114 which is normally covered by a resilient washer 116. An internally threaded cap 118 is threaded onto the wick support tube 110, and when the cap 118 is tightened, the washer 116 is effective to seal the breather hole 114 and also form a fluid-tight seal between the cap 108 and cap 118 to prevent any leakage from the container 105.

A cup-shaped adaptor 125 is molded of a rigid plastics material and snap fits onto the bottom of the metal container 105. The adaptor 125 has a pair of diametrically opposite wedge-shaped flanges 126 which are positioned to wedge under the cam blocks or portions 93 within the base cap 90 when the adaptor 125 is inserted into the base cap and rotated by about 90 degrees.

From the drawing and the above description, it is apparent that a collapsible lantern constructed in accordance with the present invention, provides desirable features and advantages. As one important advantage, the lantern has a relative inexpensive construction since the housing 16, coupling 48, base cap 90 and adaptor 125 may all be easily molded of a rigid plastics material. As another feature, when the lantern 15 is in its collapsed position, as shown in FIG. 1, the globe 45 projects downwardly into the surrounding housing 16 and around the candle shell 76 or candle oil container 105 so that the globe 45 is protected by the housing 16 from being accidentally scratched or broken. When the globe 45 is in the position shown in FIG. 2, the globe may be easily removed for cleaning, simply by unsnapping the upper hook portions 54 of the retainer arms 51.

The lantern 15 also provides for selecting different fuel sources depending upon the use of the lantern and the availability of the lamp oil. The annular coupling 48 is conveniently and quickly connected or attached to the housing 16 in either the collapsed position (FIG. 1) or the erected position (FIG. 2), and the support handle or bail 29 shifts automatically between its collapsed position (FIG. 1) to its extended position (FIG. 2) when the lantern 15 is lifted with the bail 29.

While the forms of lantern herein described constitute preferred embodiments of the invention, it is to be understood that the invention is not limited to these precise forms, and that changes may be made therein without departing from the scope and spirit of the invention as defined in the appended claims.

The invention having thus been described, the following is claimed:

1. A collapsible lantern comprising a tubular housing having an upper end portion and a lower end portion, means forming a bottom for said lower end portion of said housing, a tubular transparent globe smaller than said housing and having opposite end portions, an annular coupling member, means for securing said coupling member to one of said end portions of said globe, means for releasably connecting said coupling member to said upper end portion of said housing with said globe projecting upwardly from said housing, a fuel source disposed within said housing and including a wick, said globe being insertable into said housing in surrounding relation to said fuel source after said coupling member is released from said housing and said globe and coupling member are inverted as a unit, and means for releasably connecting said coupling member to said upper end portion of said housing with said globe projecting downwardly into said housing.

2. A lantern as defined in claim 1 wherein said means for securing said coupling member to one of said end portions of said globe comprise a set of arms secured to said coupling member and having portions releasably engaging the other said end portion of said globe member.

3. A lantern as defined in claim 2 wherein said portions of said arms comprise hook-shaped end portions forming a snap-fit onto said globe member to provide convenient removal of said globe member from said coupling member.

4. A lantern as defined in claim 1 wherein said means forming a bottom wall for said housing comprise a base closure member releasably connected to said lower end portion of said housing, and means for releasably securing said fuel source to said base closure member.

5. A lantern as defined in claim 4 wherein said fuel source includes means forming an outwardly projecting base flange, and said base closure member includes a portion for receiving said base flange.

6. A lantern as defined in claim 5 wherein said fuel source comprises a container for receiving a lamp oil, and a base adaptor mounted on said container and including said base flange.

7. A lantern as defined in claim 5 wherein said fuel source comprises a candle including said wick, a casing surrounding said candle, a compression spring within said casing and urging said candle upwardly within said casing, and said casing includes said base flange.

8. A lantern as defined in claim 1 wherein said means for connecting said coupling member to said housing comprise at least one projection on said coupling member, and said housing includes means defining at least one bayonet-type slot for receiving said projection.

9. A lantern as defined in claim 1 and including a pair of support strips having upper end portions and supported by said housing for vertical sliding movement, and a bail-type handle connecting said upper end portions of said strips.

10. A lantern as defined in claim 1 wherein said coupling member includes a set cf peripherally spaced and slightly flexible tab portions, and friction detent means connecting said tab portions to said housing and forming said releasably connecting means with said globe projecting downwardly into said housing.

11. A lantern as defined in claim 10 wherein said means for securing said coupling member to said globe comprise a set of peripherally spaced flexible arms secured to said tab portions and having hook means for releasably engaging said globe.

12. A collapsible lantern comprising a tubular housing having an upper end portion and a lower end portion, a bottom closure member removably attached to said lower end portion of said housing, a tubular transparent globe smaller than said housing and having opposite end portions, an annular coupling member, means for removably securing said coupling member to one of said end portions of said globe, means for releasably connecting said coupling member to said upper end portion of said housing with said globe projecting upwardly from said housing, a fuel source disposed within said housing and including a wick, said fuel source being removable from said housing after said bottom closure member is removed from said housing, said globe being insertable into said housing in surrounding relation to said fuel source after said coupling member is released from said housing and said globe and coupling member are inverted as a unit, and means for releasably connecting said coupling member to said upper end portion of said housing with said globe projecting downwardly into said housing.

13. A lantern as defined in claim 12 wherein said means for securing said coupling member to one of said end portions of said globe comprise a set of arms secured to said coupling member and having hook-shaped end portions releasably engaging the other said end portion of said globe member.

14. A lantern as defined in claim 12 wherein said fuel source includes means forming an outwardly projecting base flange, and said bottom closure member includes a portion for receiving said base flange.

15. A lantern as defined in claim 14 wherein said fuel source comprises a container for receiving a lamp oil, and a base adaptor mounted on said container and including said base flange.

16. A lantern as defined in claim 14 wherein said fuel source comprises a candle including said wick, a casing surrounding said candle, a compression spring within said casing and urging said candle upwardly within said casing, and said casing includes said base flange.

17. A lantern as defined in claim 14 wherein said means for connecting said coupling member to said housing comprise at least one projection on said coupling member, and said housing includes means defining at least one bayonet-type slot for receiving said projection.

18. A lantern as defined in claim 12 and including a pair of support strips having upper end portions and supported by said housing for vertical sliding movement, and a bail-type handle connecting said upper end portions of said strips.

19. A lantern as defined in claim 12 wherein said coupling member includes a set of peripherally spaced and slightly flexible tab portions, and friction detent means connecting said tab portions to said housing and forming said releasably connecting means with said globe projecting downwardly into said housing.

20. A collapsible lantern comprising a rigid plastic tubular housing having an upper end portion and a lower end portion, a rigid plastic bottom closure member removably attached to said lower end portion of said housing, a tubular transparent globe smaller than said housing and having opposite end portions, a rigid plastic annular coupling member, means for securing said coupling member to one of said end portions of said globe, means for releasably connecting said coupling member to said upper end portion of said housing with said globe projecting upwardly from said housing, a fuel source disposed within said housing and including a wick, means for attaching said fuel source to said closure member, said fuel source being removable from said housing through said lower end portion of said housing after said closure member is removed from said housing, said globe being insertable into said housing in surrounding relation to said fuel source after said coupling member is released from said housing and said globe and coupling member are inverted as a unit, and means for releasably connecting said coupling member to said upper end portion of said housing with said globe projecting downwardly into said housing.

* * * * *